United States Patent [19]

Singleton et al.

[11] 4,288,311

[45] Sep. 8, 1981

[54] CONTACTOR AND DANGLER ASSEMBLY FOR PLATING BARREL

[75] Inventors: Albert Singleton, 7360 Brookside Pkwy., Middleburg Heights, Ohio 44130; Raymund Singleton, North Ridgeville, Ohio

[73] Assignee: Albert Singleton, Cleveland, Ohio

[21] Appl. No.: 113,220

[22] Filed: Jan. 18, 1980

[51] Int. Cl.[3] ..... C25D 17/00; C25D 17/20; H01R 4/24

[52] U.S. Cl. ..... 204/279; 204/213; 339/100

[58] Field of Search ..... 204/279, 213-214, 204/280, 289; 174/73 R, 74 R, 90, 93; 339/100

[56] References Cited

U.S. PATENT DOCUMENTS

| | | | |
|---|---|---|---|
| 2,034,695 | 3/1936 | Dougherty | 339/100 X |
| 2,777,117 | 1/1957 | Shrider | 339/100 |
| 2,940,060 | 6/1960 | Haegert | 339/100 |
| 3,109,691 | 11/1963 | Burkhardt | 339/100 |
| 3,366,566 | 1/1968 | Sandrock | 204/279 X |
| 3,560,909 | 2/1971 | Wyatt et al. | 339/110 |
| 3,844,923 | 10/1974 | Sandrock | 204/279 |
| 3,860,320 | 1/1975 | Danner | 339/100 |
| 4,050,773 | 9/1977 | Newell | 339/110 X |
| 4,111,781 | 9/1978 | Smith et al. | 204/279 X |

*Primary Examiner*—Donald R. Valentine
*Attorney, Agent, or Firm*—Fay & Sharpe

[57] ABSTRACT

A contactor and a dangler assembly for particular use in a plating barrel for electro-chemical plating operations. The dangler assembly is comprised of a sheathed electrical conductor having a connector disposed at one end and the contactor disposed at the other end. The contactor is comprised of a generally cylindrical housing and an elongated lag screw. An internal passageway defined by three coaxial bore sections extends between opposed casing outer and inner ends and is dimensioned to closely receive a portion of the length of the sheathed electrical conductor from the cable other end. The side wall of the second or central one of the bore sections is advantageously threaded substantially over the length thereof to enhance conductor retention thereby. Upon insertion of the lag screw into the passageway from the casing inner end, the lag screw shank axially penetrates the electrical conductor to cause radial expansion thereof into close retained engagement by the passageway side wall. The threads of the lag screw and passageway second bore section are of the opposite hand and the pitch of the lag screw threads is greater than the pitch of the second bore section threads. A protective sleeve is loosely received over at least a portion of the sheathed electrical conductor length adjacent the contactor. This sleeve protects the conductor from impingement by work pieces being processed in the plating barrel.

13 Claims, 4 Drawing Figures

CONTACTOR AND DANGLER ASSEMBLY FOR PLATING BARREL

BACKGROUND OF THE INVENTION

This invention pertains to the art of electrode terminations and more particularly to a dangler assembly for electro-chemical apparatus.

The invention is particularly applicable to a field-removable and field-installable contactor and dangler assembly typically used in a plating barrel by the electro-chemical plating industry. However, it will be appreciated to those skilled in the art that the invention could be readily adapted for use in other environments as, for example, where similar electrode terminations are employed for the conduction of electrical energy.

In electroplating or metal finishing operations employing a plating barrel, a dangler assembly is normally used as a cathode, as disclosed in U.S. Pat. No. 4,111,781. The end of the dangler assembly which is inserted into the plating barrel is usually comprised of a casing of heavy metal such as stainless steel, and is commonly referred to as the contactor or "ball. " The contactor, in turn, is mounted on heavy electrical cable and together, these components typically are required to regularly conduct 4000 amps. The contactor, as well as that portion of the cable which is inserted into the plating barrel, is exposed to a harsh environment of corrosive chemicals and constantly impinging work pieces being processed.

Various forms and types of dangler assemblies have heretofore been suggested and employed in the industry, all with varying degrees of success. Typically, however, prior dangler assemblies variously comprise heavy cables with cup-shaped contactors fastened thereon by soldering or crimping methods. It has been found that the defects present in such assemblies are such that they are of limited economic and practical value.

More particularly, and as to prior assemblies employing solder for securing the contactor to the cable, it has been found that the exposed solder is particularly vulnerable to the corrosive chemicals used in electroplating operations. As the solder is dissolved, the bond between the contactor and cable weakens until the contactor and cable eventually separate. In addition, soldering operations have the inherent drawbacks of being relatively high in cost and causing excessive environmental pollution.

Prior dangler assemblies which employ crimping means for securing the contactor to the cable have the disadvantage of increased electrical resistance in the contactor. This characteristic is due to physical deformation and which results in heating and conductance inefficiencies.

Both types of prior art dangler assemblies have also suffered from the problem of not facilitating field repair or installation capabilities for the contactor. In the event of contactor separation or failure, it has heretofore been necessary to replace the entire dangler assembly. Moreover, heavy machinery is required to effect both the cold-rolling or crimping and soldering methods of connection.

The present invention contemplates a new and improved arrangement which overcomes all of the above referred to problems and others to provide a new contactor and a dangler assembly which are simple in design, economical to manufacture, easy to install, easy to remove, field serviceable, and which provide improved cathodic conductance in a plating barrel operation.

BRIEF SUMMARY OF THE INVENTION

In accordance with the present invention, there is provided a new and improved contactor and a new dangler assembly particularly suited for use in and as an electrode termination in electro-chemical apparatus such as in a plating barrel operation or the like. This dangler assembly itself is generally comprised of a sheathed electrical conductor having a connector disposed at one end and the contactor disposed at the opposite end. The contactor is comprised of a generally cylindrical open-ended casing and an elongated mechanical fastener in connecting or retaining cooperation with the conductor from the inner end of the casing. The casing has a first bore section at its outer end which closely receives a portion of the sheathed electrical conductor adjacent the one end thereof. A second bore section which is smaller than and adjacent the first bore section closely receives a sheathless area of the electrical conductor at its one end. A third bore section disposed at the casing inner end communicates with the second bore section and closely receives the shank of the mechanical fastener.

In accordance with another aspect of the present invention the mechanical fastener comprises a threaded lag screw which extends axially of the casing and has a length sufficient to extend at least through the third and second bore portions. Preferrably, this length is sufficient to extend at least partially into the first bore section.

According to another aspect of the invention, the second bore section includes threads on the side wall thereof over at least a substantial portion thereof from the first toward the third bore sections.

According to a further aspect of the invention, the threads of the lag screw and second bore section are of the opposite hand. Desirably, the pitch of the lag screw threads is greater than the pitch of the second bore section threads.

In accordance with still another aspect of the present invention, a loose-fitting protective sleeve is provided to surround the conductor over at least a portion of the length thereof from the contactor casing.

One benefit obtained from the present invention is a contactor and a dangler assembly which are field-installable and field-repairable.

Another benefit is in the provision of a contactor and a dangler assembly which have improved resistance to damage from the impingement of work pieces.

A further benefit of the present invention resides in a contactor and a dangler assembly having improved conductance capabilites.

Other benefits and advantages for the subject invention will become apparent to those skilled in the art upon a reading and understanding of this specification.

BRIEF DESCRIPTION OF THE DRAWINGS

The invention may take physical form in certain parts and arrangement of parts, the preferred embodiment of which will be described in detail in this specification and illustrated in the accompanying drawings which form a part hereof and wherein.

DETAILED DESCRIPTION OF THE PREFERRED EMBODIMENT

Figure 1:
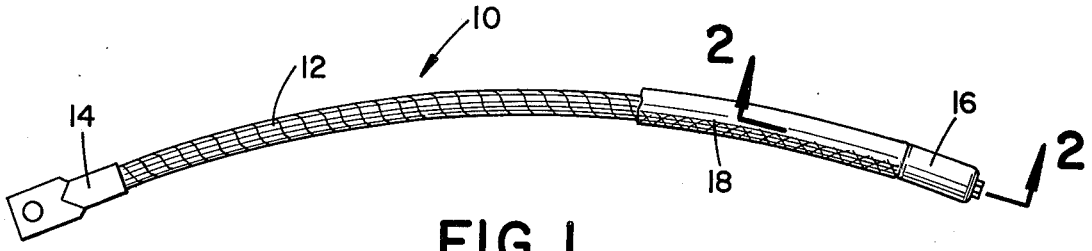
FIG. 1 is a perspective view of a dangler assembly formed in accordance with the present invention.

Referring now to the drawings wherein the showings are for purposes of illustrating the preferred embodiment of the invention only and not for purposes of limiting same, FIG. 1 shows a dangler assembly 10 comprised of a sheathed electrical conductor 12, an electrical connector 14, a contactor 16 and a protective sleeve 18.

Figure 2:
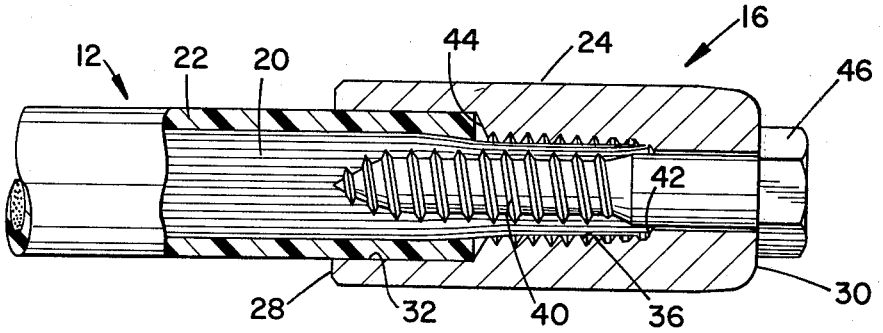
FIG. 2 is an enlarged cross-sectional view taken along lines 2—2 of FIG. 1.

More specifically and with reference to FIGS. 1 and 2, sheathed electrical conductor 12 is comprised of electrical conductor 20 and an insulating protective sheath 22. Electrical conductor 20 may be constructed from any number or form of low-resistance materials but preferrably comprises a flexible, multi-strand copper electrical cable. Sheath 22 may be constructed from any flexible insulating material but is preferrably comprised of rubber, synthetic rubber, plastic or the like material. In the preferred embodiment, and merely by way of example, sheathed electrical conductor 12 consists of 600 volt, number 4/0 welding cable.

Protective sleeve 18 is preferrably constructed of a plastic material and is loosely received over at least a portion of the sheathed electrical conductor 12. The location for this sleeve is closely adjacent the contactor 16 to additionally protect the dangler assembly from harmful impingement of work pieces being processed in a plating barrel operation.

Figure 3:
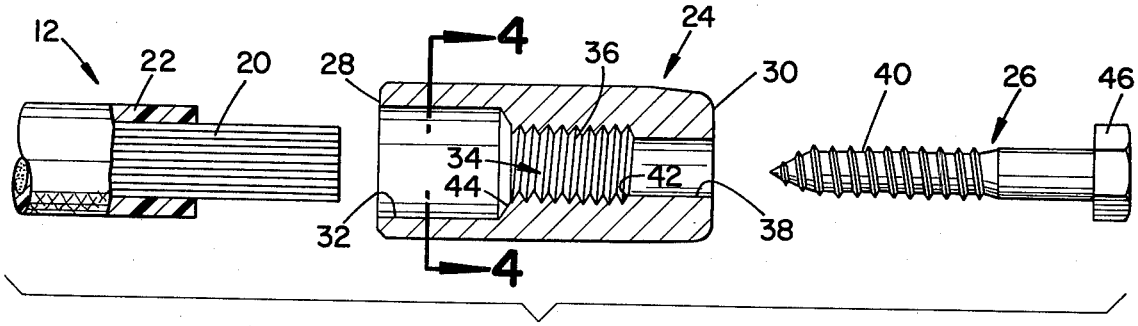
FIG. 3 is an exploded view of the structure shown in FIG. 2.
Figure 4:
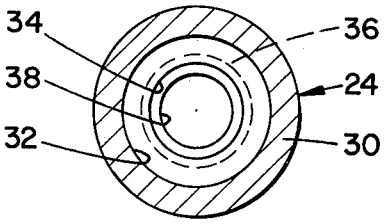
FIG. 4 is a cross-sectional view of the casing taken along lines 4—4 of FIG. 3.

With particular reference to FIGS. 2, 3 and 4, contactor 16 is comprised of cylindrical casing 24 and lag screw 26. Casing 24 is preferrably of a durable conductive material such as stainless steel or the like and has an internal passageway extending between opposed outer and inner ends 28, 30. A passageway first bore section 32 extends inwardly into the casing from outer end 28 and is generally dimensioned to closely receive a longitudinal section of conductor 20 and protective sheath 22. A second bore section 34 having a smaller diameter than first section 32 interfaces with the first section and extends further axially into casing 24 therefrom. Second bore section 34 is dimensioned to receive sheathless electrical conductor 20 and desirably includes a threaded portion 36 substantially over the length thereof from the first toward the third bore section to more securely grasp electrical conductor 20. Preferably, at least second bore section closely receives conductor 20 upon insertion of the conductor thereinto. A passageway third bore section 38 axially communicates with second bore section 34. This third section is of a lesser diameter than second bore section 34 and extends to casing inner end 30. As will be described, third bore section 38 is dimensioned so that the elongated shanks of lag screw 26 may be passed therethrough.

Lag screw 26 advantageously has a durable metallic construction and is threaded as at 40 over a portion of the shank length. The pitch of threaded portion 40 is preferrably greater than the pitch of threaded portion 36 of second bore section 34. Moreover, the thread directions of threaded portions 36, 40 are of the opposite hands. This feature provides improved interlocking engagement strength with sheathed electrical conductor 12 as will be described. in the preferred embodiment, threaded area 40 is right handed and threaded portion 36 of the second bore section is left handed.

OPERATION

With particular reference to FIGS. 2 and 3, the improved operational characteristics of the subject new dangler assembly will be specifically discussed.

Cylindrical casing 24 receives sheathed electrical conductor 12 from casing outer end 28 with an end portion of the sheath removed to expose electrical conductor 20. The casing is dimensioned so that bore sections 32, 34 accommodate sheathed electrical conductor 12 and electrical conductor 20 in a snug but non-compressive receiving relationship. Casing 24 may be threadedly advanced onto the conductor until electrical conductor 20 bottoms out against the end wall or face 42 of second bore section 34 or until the protective sheath 22 bottoms out against the inner end or face 44 of first bore section 32.

Casing 24 and sheathed electrical conductor 12 are then secured and lag screw 26 is threadedly advanced axially into the electrical conductor 20 through the third bore section 38 from casing inner end 30. Because of the dimensional relationships between the components, a wrench or power tool is required to completely advance the lag screw 26 through casing 24 and into conductor 12. As the lag screw is thus advanced, conductor 20 is radially expanded to securely engage the side wall surface of the second bore section 34, i.e., threaded portion 36. A particular feature of the invention is that as right-handed lag screw 26 is advanced, electrical conductor 20 is forced into rotational movement against left-hand threaded portion 36. As a result, electrical conductor 20 is drawn further into casing 24 and the thread-to-thread sealing or retaining force is thereby increased. As increased torque is applied to lag screw 26, threaded portion 40 thereof is further advanced axially into electrical conductor 20. The length of the lag screw shank is such that the outermost end or top thereof may preferrably extend into first bore section 32. This, in turn, causes protective sheath 22 to be wedged into engagement with the side wall surface of first bore section 32 to seal casing inner end 28 against the harsh environment to which the dangler assembly 10 will be subjected. Lag screw 26 is threadedly advanced into casing 24 until the head 46 thereof abuts casing inner end 30.

After the contactor 16 is attached to sheathed electrical conductor 12 in the manner described, protective sleeve 18 may be positioned on sheathed electrical conductor 12 in the position shown in FIG. 1 the dangler assembly may be operably installed to a plating barrel and in a conventional manner by means of connector 14. Connector 14 is connected to conductor 12 by conventional known means which do not form a part of the present invention. Moreover, it is desired that protective sleeve 18 be dimensioned so as to be movably and/or rotatable relative to conductor 12.

The assembly of the subject invention is field installable, repairable and removable without the necessity of using heavy machinery as has heretofore been the case for some prior art dangler assemblies for obtaining contactor soldering and crimping. In addition, the new dangler assembly is simpler and easier to use than other field installable assemblies which have been previously known.

The invention has been described with reference to the preferred embodiment. Obviously modifications and alterations will occur to others upon the reading and understanding of the specification. It is our intention to include all such modifications and alterations insofar as they come within the scope of the appended claims or the equivalent thereof.

We claim:

1. A dangler assembly for an electro-chemical apparatus comprising in combination:

an elongated electrical conductor, an insulating sheath closely surrounding said conductor, an electrical connector disposed at one terminal end of said conductor, and, a contactor disposed at the opposite terminal end of said conductor;

said contactor comprising a generally cylindrical open ended casing having opposed inner and outer ends with a first bore section extending axially thereinto from said outer end receiving a longitudinal portion of said electrical conductor and insulating sheath adjacent said conductor opposite terminal end, a second bore section communicating with said first bore section extending further axially into said casing toward said inner end, having a threaded side wall at least substantially over the length thereof, and receiving a portion of the length of said conductor at said conductor opposite end, a third bore section communicating between said second bore section and said casing inner end axially of said casing and elongated fastening means, comprising a threaded lag screw extending from said casing inner end through said third and said second bore sections and through at least a portion of said first bore section to penetrate at least a portion of said conductor received in said first bore section, and including threads of the opposite hand from the threads of said second bore section side wall;

said fastening means axially penetrating said conductor from said opposite terminal end thereof for radially expanding said conductor into retained engagement with the side wall of said second bore section.

2. The assembly of claim 1 wherein the pitch of said lag screw threads is greater than the pitch of said second bore section threads.

3. The assembly of claim 1 wherein said lag screw is dimensioned to extend substantially the entire length of said casing from said inner end to said outer end.

4. The assembly of claim 1 further including a protective sleeve of plastic material received over a portion of the length of said insulating sheath adjacent said contactor and dimensioned to be in a loose-fitting relationship therewith for allowing movement and rotation of said sleeve relative to said sheath.

5. The assembly of claim 1 wherein said first, second and third bore sections are coaxial with said first bore section, said first bore section having a diameter greater than said second bore section and said second bore section having a diameter greater than said third bore section.

6. A dangler assembly for an electro-chemical apparatus comprising in combination:

an elongated electrical conductor, an insulating sheath closely surrounding said conductor, an electrical connector disposed at one terminal end of said conductor, and, a contactor disposed at the opposite terminal end of said conductor;

said contactor comprising a generally cylindrical openended casing having opposed inner and outer ends with a first bore section extending axially thereinto from said outer end receiving a longitudinal portion of said electrical conductor and insulating sheath adjacent said conductor opposite terminal end, a second bore section communicating with said first bore section extending further axially into said casing toward said inner end, having a threaded side wall at least substantially over the length thereof, and receiving a portion of the length of said conductor at said conductor opposite end, and a thrid bore section communicating between said second bore section and said casing inner end axially of said casing; and an elongated threaded fastener extending from said casing inner end through said third bore section and through at least a portion of said second bore section, and axially penetrating said conductor from said opposite terminal end thereof for radially expanding said conductor into retained engagement with the side wall of said second bore section, the threads of said fastener being of the opposite hand from the threads of said second bore section side wall.

7. A dangler cable contactor for use in a plating barrel wherein the contactor is fixedly securable to one end of an associated electrical cable having an electrical conductor and an outer insulating sheath, said contactor comprising:

a casing having opposed outer and inner ends with an internal passageway extending therebetween, said passageway including first, second and third bore sections from said outer toward said inner end with each successive bore section from said first bore section decreasing in diameter; a threaded fastener having an elongated threaded shank receivable in said passageway from said inner end for fixedly securing said casing on said one end of said electrical cable; said second bore section being dimensioned to closely receive a section of said electrical conductor and including threads substantially over the length thereof of the opposite hand from the threads of said fastener; and, said first bore section being dimensioned to closely receive a section of said electrical conductor and said insulating sheath of said electrical cable, whereby insertion of said fastener into said passageway from said casing inner end causes said fastener to axially penetrate said electrical conductor and effect radial expansion of same into retained engagement with at least said second bore section.

8. The contactor as defined in claim 7 wherein the pitch of the threads on said elongated threaded shank is greater than the pitch of the threads in said second bore section.

9. The contactor as defined in claim 7 wherein said fastener includes head and shank portions, said head portion having a dimension greater than the diameter of said third bore section and said shank having a length sufficient to extend through said passageway and at least into said first bore section from said casing inner end when said head portion abuts said inner end.

10. A dangler assembly for an electro-chemical apparatus comprising in combination:

an electrical cable including an insulating sheath surrounding an electrical conductor, an electrical connector disposed at one terminal end of said cable, and a contactor disposed at the opposite terminal end of said cable;

said contactor comprising a generally cylindrical open-ended casing having opposed inner and outer ends with an internal passageway extending therebetween, said passageway including first, second, and third bore sections from said outer toward said inner end with each successive bore section from said first bore section decreasing in diameter; elongated fastening means receivable in said passageway from said inner end for fixedly securing said casing on said opposite terminal end of said cable; a portion of said electrical conductor closely received in said second bore section in compressive engagement between a threaded side wall of said second bore section and said fastening means; and, a portion of said electrical cable closely received in said first bore section, whereby insertion of said fastening means into said passageway from said casing inner end causes said fastening means to axially penetrate said electrical cable and effect radial expansion of same into retained engagement with said casing.

11. The dangler assembly of claim 10 wherein said elongated fastening means includes a threaded shank.

12. The dangler assembly of claim 11 wherein said threaded shank includes threads of the opposite hand from said threads of said second bore sections.

13. The dangler assembly of claim 12 wherein the pitch of said fastenining means threads is greater than the pitch of said second bore section threads.

* * * * *